United States Patent [19]

Eheim, deceased et al.

[11] Patent Number: 4,887,571

[45] Date of Patent: Dec. 19, 1989

[54] SPEED GOVERNOR FOR FUEL INJECTION PUMPS

[76] Inventors: Helga Eheim, deceased, late of Stuttgart; by Franz Eheim, executor, Max-Brod-Weg 8, 7000 40, Stuttgart, both of Fed. Rep. of Germany

[21] Appl. No.: 765,984

[22] Filed: Aug. 15, 1985

[30] Foreign Application Priority Data

Sep. 12, 1984 [DE] Fed. Rep. of Germany ..... 3433423

[51] Int. Cl.[4] ..... F02M 39/00

[52] U.S. Cl. ..... 123/367; 123/357; 123/179 L

[58] Field of Search ..... 123/357–359, 123/179 L, 449, 367

[56] References Cited

U.S. PATENT DOCUMENTS 4,239,025 12/1980 Konrath ..... 123/179 L
4,430,974 2/1984 Bofinger ..... 123/387

FOREIGN PATENT DOCUMENTS 3237498 4/1984 Fed. Rep. of Germany ..... 123/357

*Primary Examiner*—Carl Stuart Miller
*Attorney, Agent, or Firm*—Edwin E. Greigg

[57] ABSTRACT

A speed governor for fuel injection pumps of internal combustion engines has an electric control motor driven via an electronic control unit for actuating a quantity control member of the injection pump. A travel limitating element of the quantity control member is provided in order to determine the maximum injection quantity. The travel limitating element is adjustable independently of the electronic control unit between a position for the starting quantity and a position for the full-load quantity in accordance with engine characteristics. While the operating rpm performance graph is controlled by the electrical portion of the speed governor, the maximum rpm is determined by hydraulic-mechanical means.

17 Claims, 6 Drawing Sheets

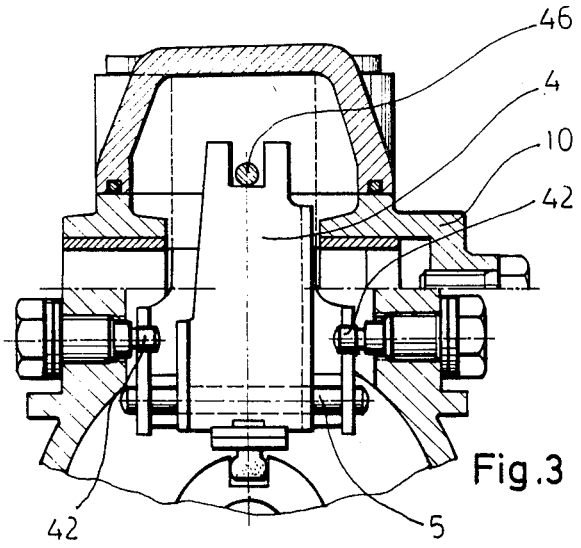
Fig.3
Fig.4
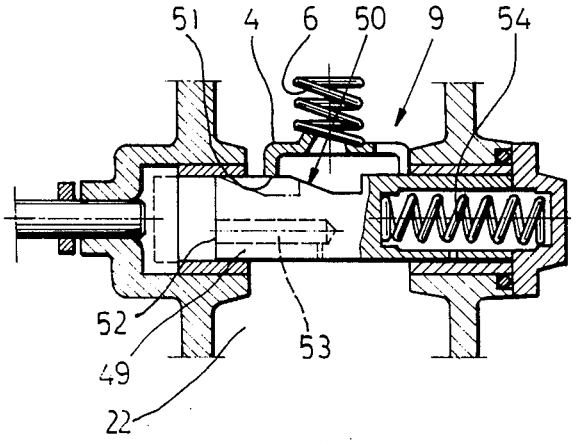
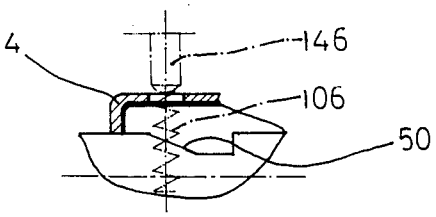
Fig. 5

SPEED GOVERNOR FOR FUEL INJECTION PUMPS

BACKGROUND OF THE INVENTION

The invention is based on an rpm governor for fuel injection pumps of internal combustion engines as generally defined hereinafter. As the combustion quality required of Diesel engines increases, in terms of fuel consumption on the one hand and the quality of the exhaust gases on the other, electric speed governors are increasingly used, because engine and environmental parameters can be converted into set-point values much more accurately and quickly with an electronic control unit than with mechanical governors. There are still problems, however, in generating the relatively large adjusting forces and performing breakaway regulation when the allowable maximum rpm has been reached, so as to prevent racing of the engine; also, especially during starting and when the engine is cold, a controlled increased injection quantity is necessary in order to attain engine concentricity.

In a known speed governor of the above general type (British Pat. No. 2,073,448), the variable position of the quantity control member is measured via a transducer disposed in the control motor; the transducer operates like a potentiometer and supplies an electrical signal representing the actual position of the control motor adjusting member to the electric control unit. A two-part lever that is pivotable about an adjustable shaft is disposed between the control motor and the quantity control member, so that when the drag member part that is connected to the quantity control member meets the travel limiting means, the quantity control member can no longer be displaced further, yet the control motor need not stop as a result. Thus the position feedback means provides actual information to the electric control unit only about the position of the adjusting member of the control motor, not about the position of the quantity control member. Although the maximum rpm is limited by the travel limiting means in this known speed governor, it is not clear how the increased starting fuel quantity can be controlled with a governor of this kind.

In another known speed governor of the above general type, the entire rpm range, including starting and full load, is controlled via the electric control motor, which involves the danger of engine racing. For safety's sake, a bypass can be opened up via a magnetic valve, interrupting the fuel injection; however, this functions only if an electrical interruption occurs, for instance if the electricity fails. Certainly this feature is often undesirable in Diesel engines as a means of enabling emergency operation, even if it were only to be provided in the maximum rpm range, that is, by means of the full-load stop.

In any event, for speed governors having electric control motors it is very expensive to detect the actual statuses for starting and full-load quantity via an electrical position transducer, and from these values to regulate an allowable actual quantity using the electronic control unit.

OBJECT AND SUMMARY OF THE INVENTION

The speed governor according to the invention has the advantage over the prior art that a position transducer at the control motor is unnecessary, and the governor function is performed by the electric control unit and the control motor by evaluating engine parameters. The full-load and starting quantities are attained using associated travel limiting means. The result is simple speed governing with a reliable speed limitation, or breakaway regulation at full-load and starting rpm.

According to an advantageous embodiment of the invention, a stop which is adjustable between the positions for starting quantity and full-load quantity serves as the travel limiting means. According to an embodiment of the invention that should also be considered independently of the novel characteristics revealed herein a stepping final control element serves as the control motor, operating for instance with a motor spindle by way of which a lock-nut that is connected to the quantity control member serves as the adjusting element. This spindle changes the direction of rotation whenever an increase or decrease in the injection quantity is desired.

According to a further embodiment of the invention, the travel limiting means operates with a piston that is displaceable by hydraulic means counter to a spring force; fuel advantageously serves as the hydraulic means. This fuel is available to the injection pump from the feed pump, which operates at an rpm synchronized with the engine speed, and displaces the piston out of an initial position for starting rpm into a final position for normal rpm. While the hydraulic pressure of the feed pump is still very low at starting rpm, from idling rpm on it is sufficient to displace the piston. Means that are available to the injection pump are accordingly used advantageously, and the hydraulic pressure can also be controlled via a magnetic valve, which may be disposed in an inflow or outflow conduit leading to or from the piston.

According to an additional embodiment of the invention, the piston is displaceable either in the actuation direction of the control motor, or transversely thereto. In the latter case, a stepped stop disposed for instance in the jacket surface of the piston can be displaceable with the piston. As a result, depending on the position of the piston, there is a variable travel limitation, and it is also possible to attain a gradual transition between the starting quantity and the full-load quantity.

The travel and force of the control motor, on the one hand, and of the quantity control member, on the other, can advantageously be accomplished in accordance with the invention by means of a pivotably supported governor lever, which is pivotable by the control motor in the direction for either increasing or decreasing quantity, counter to the force of a restoring spring. The governor lever may comprise a starting lever plus a pivoting lever which are pivotable about the same shaft, with the control motor engaging the pivoting lever and the starting lever articulating the quantity control member, both levers being combined into an adjusting unit by means of a starting spring. By means of a travel limitation at starting rpm until the idling rpm is attained, the starting lever can be displaced by the pivoting lever, counter to the force of the starting spring, in the direction of an increased starting quantity. As a result, the travel limitation for the increased starting quantity is independent of that for the full-load quantity.

The invention will be better understood and further objects and advantages thereof will become more apparent from the ensuing detailed description of preferred embodiments, taken in conjunction with the drawings.

BRIEF DESCRIPTION OF THE DRAWINGS

Two exemplary embodiments of the invention are shown in the drawing, the first exemplary embodiment in FIGS. 2–8 and the second in FIG. 9.

FIG. 3 is a section taken along the line III—III in FIG. 2;

FIG. 4 is a section taken along the line IV—IV in FIG. 2;

FIG. 5 is a detail of FIG. 4 showing a different position for the slide;

DESCRIPTION OF THE PREFERRED EMBODIMENTS

Figure 1:
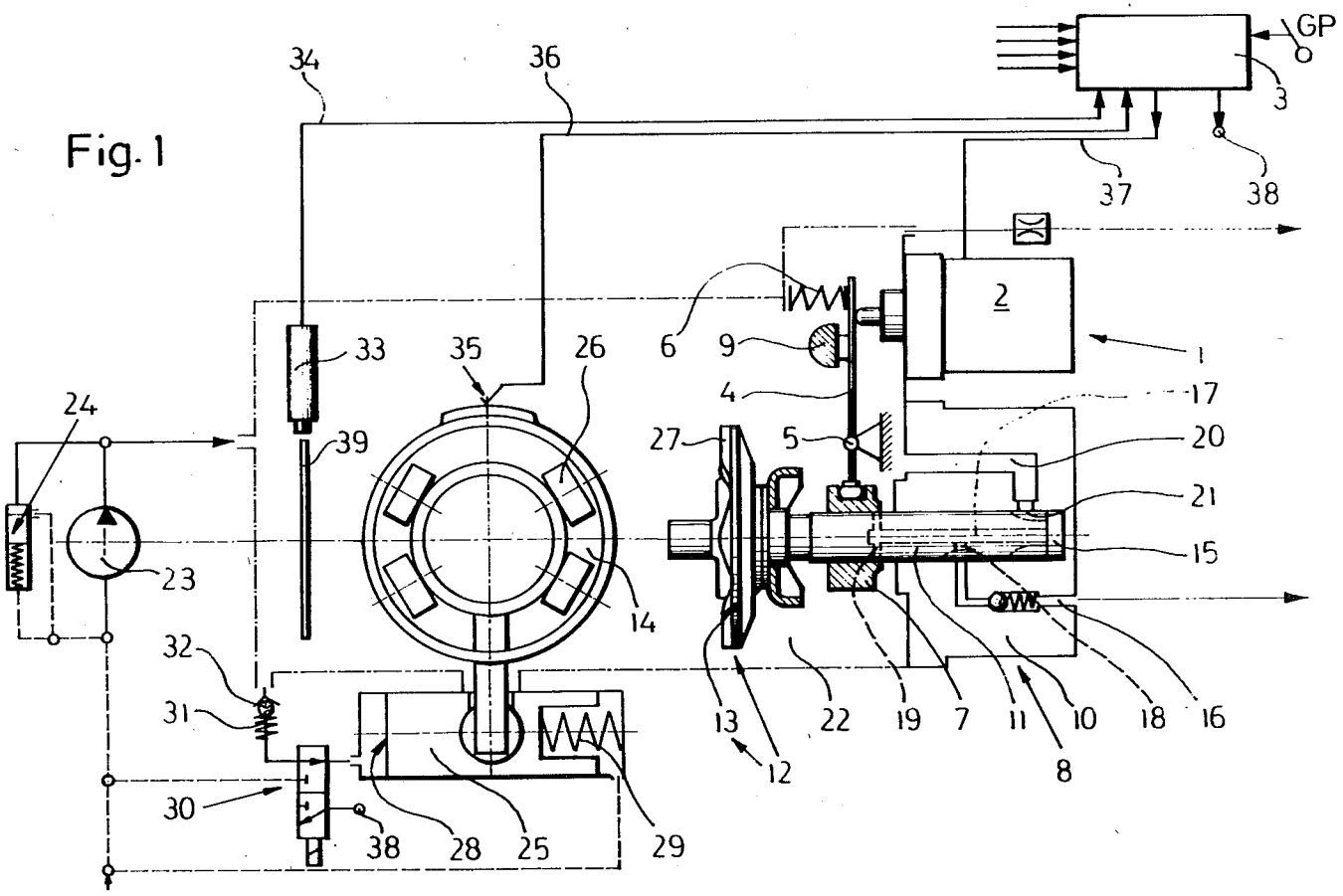
FIG. 1 shows a fuel injection system having a speed governor according to the invention in a schematic illustration.

A speed governor 1 according to the invention and intended for governing the fuel injection quantity is integrated into the injection system schematically shown in FIG. 1. This speed governor has a control motor 2, which is driven by an electronic control unit 3 and acts upon a governor lever 4, which is pivotable about a shaft 5 and at its end is biased by a spring 6 in the direction toward the control motor 2; with its other end, the governor lever actuates a quantity control member 7 of an injection pump 8. The pivoting range of the governor lever 4 and hence the maximum injection quantity are determined by a travel limiter As the injection pump 8, a pump piston 11 operates in a housing 10 being set into simultaneously reciprocating and rotary motion by a cam drive 12 having a cam disk 13 and a roller ring 14. For the sake of better understanding of the invention, the roller ring 14, shown in plan view, is tilted by 90° into the plane of the drawing with respect to the cam disk 13. While the reciprocation serves to effect the actual pumping movement, the pump piston 11 being moved back and forth within a pump work chamber 15, the rotary motion serves to pump the fuel from the pump work chamber 15 via pressure lines 16 to the individual engine cylinders in succession; the number of cylinders corresponds to the number of pressure strokes per rotation of the pump piston 11 and to the number of pressure lines 16, only one of which is shown. A blind bore 17 is disposed in the pump piston, communicating with the pump work chamber 15; branching off from the blind bore 17 is a distributor bore 18, which during one rotation and during each pressure stroke connects the pump work chamber 15 with each of the pressure lines 16 in succession. This blind bore 17 is also intersected by a control bore 19, the ends of which are controlled by the quantity control member 7, which is embodied as an annular slide. Depending on the axial position of the quantity control member 7, which is determined by the governor, this control bore 19 is opened up earlier or later during the pressure stroke; this corresponds to a smaller or larger injection quantity. The longer the control bore remains blocked during the pressure stroke, the larger is the injection quantity pumped from the pump work chamber 15 to the particular engine cylinder associated with it at that time. The pump work chamber 15 is filled during the intake stroke of the pump piston 11 via an intake bore 20 and fill grooves 21, the number of which corresponds to the number of intake strokes per rotation of the pump piston 11.

Both the intake bore 20 and the control bore 19, if the latter has just been opened up, discharge into a suction chamber 22 of the injection pump, which is supplied with fuel by a feed pump 23. This fuel is kept below a predetermined excess pressure, which varies with the engine speed, by a pressure control valve 24. The feed pump 23 is accordingly driven at an rpm that is synchronized with the engine speed.

The roller ring 14, which is stationary in the housing, can be relatively rotated by an injection adjuster piston 25, so that the relative position of the rollers 26 of the roller ring 14 with respect to the cams 27 of the cam disk 13 is variable; thus the onset of the pressure stroke of the pump piston 11 and hence the onset of injection of fuel into the engine cylinders vary accordingly. The injection adjuster piston 25 is acted upon by fuel from the suction chamber 22 at its end face 28 and is displaced counter to a restoring spring 29 as soon as the balance of forces between the fluid pressure and the spring force changes. This pressure furthermore, can be controlled by a magnetic valve 30, which is disposed in the inflow line 31 from the suction chamber 22, and in which inflow line 31 a check valve 32 is also provided. The magnetic valve 30 is embodied as a 3/2-way valve having a connection toward the intake side of the feed pump 23, so that with an appropriate position of the magnetic valve 30 the pressure ahead of the end face 28 can be dropped very rapidly.

The speed of the injection pump is detected via an rpm transducer 33 and fed to the electronic control unit 3 via an electrical line 34. The rotational position of the roller ring 14 is detected via an injection adjustment transducer 35 and also fed to the electronic control unit 3, this time via the electrical line 36. The electronic control unit 3 also receives additional engine characteristics, such as the temperature T, the air pressure $P_L$ and the load $G_P$, processes them as programmed, and supplies them in the form of set-point values to the control motor 2 via an electrical line 37 and to the magnetic valve 30 via an electrical line 38. By evaluating the actual values detected by the transducers 33, 35 and those for T, $P_L$ and $G_P$, the electronic control unit calculates the set-point values, which then, by conversion, effect a displacement of the quantity control member 7 via the control motor 2 and of the injection adjuster piston 25 via the magnetic valve 30. The adjustment in the direction of a greater injection quantity and thus the maximum injection quantity are determined by the travel limiter 9. This travel limiter 9 is variable in its position, as will be described below, so that in accordance with rpm, a larger quantity is injectable at starting rpm than during normal operation, because a larger injection quantity is required for starting rpm, and if necessary when the engine is cold as well, in order to attain smooth engine operation.

Naturally some other type of injection pump, such as an in-line pump or slide-type high-pressure injection pump can be used instead of the distributor injection pump described above, as long as it is possible to use the speed governor according to the invention in such a pump.

Figure 2:
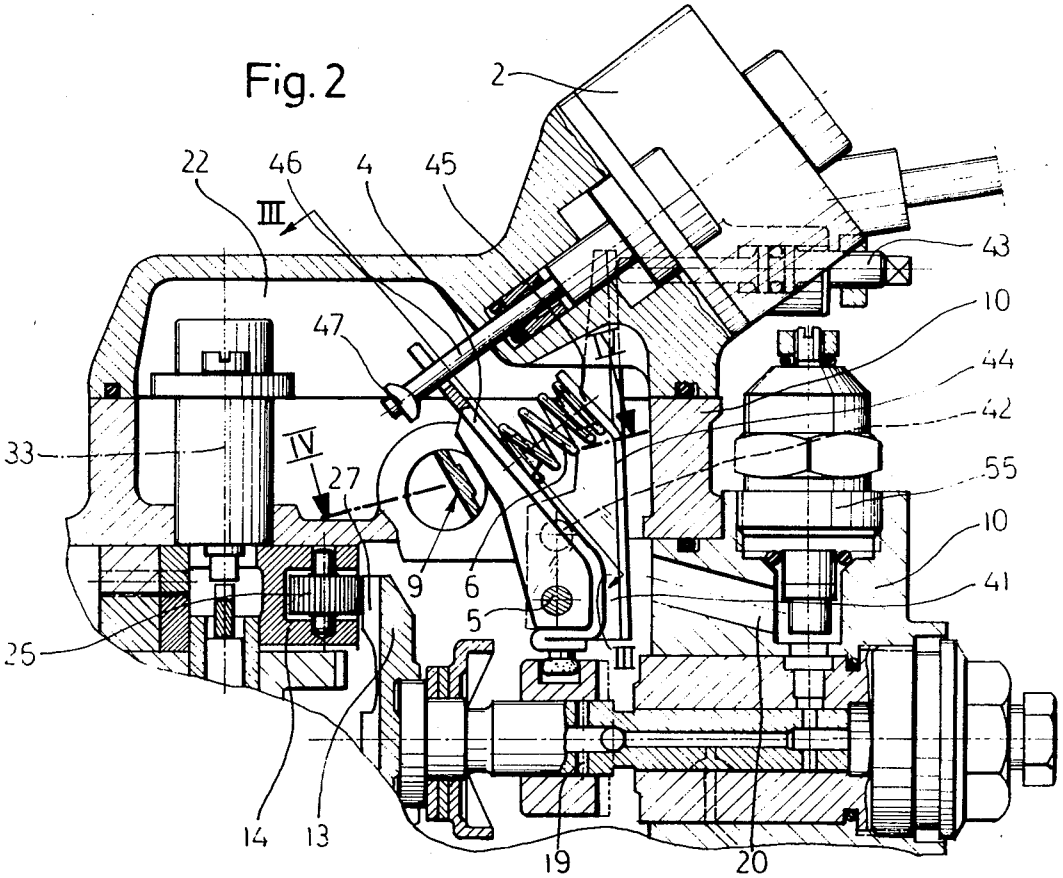
FIG. 2 is a fragmentary section through a distributor injection pump having a speed governor according to the invention.

In FIG. 2, the speed governor 1 (without the electronic control unit 3) and the injection pump 8 are shown in a fragmentary section through a distributor injection pump. In further detail to what is shown in FIG. 1, the pivot shaft 5 is disposed on an adjusting lever 41, which is adjustable via an adjusting screw 43 about an adjusting shaft 42 supported by the housing 10. The adjusting lever 41 has a bent section 44, on which a tab 45 is provided, which serves as the abutment for the spring 6, which is supported at its other end on the governor lever 4.

The control motor 2 has an actuation member 46, which cooperates with the governor lever 4 in such a manner that when the actuation member 46 is retracted into the control motor 2, the governor lever 4 is drawn counter to the spring 6. To this end, a driver plate 47 is disposed on the actuation member 46, its relative position on the actuation member 46 being variable for adjustment purposes. As soon as the governor lever 4 rests on the travel limiter 9 as the actuation member 46 moves outward, the actuation member 46 is capable of moving outward beyond this position without being hindered by the governor lever. A second final position of the quantity control member 7 which is moved by the governor lever 4 is shown in broken lines, corresponding to the starting speed and for which the lever is displaced by the distance x in the direction toward an increased fuel quantity.

In FIG. 4, the travel limiter 9 is shown in detail. Serving as the travel limiter here is an adjustable stop piston 49, which on its surface toward the governor lever 4 has a contour 50, which is traced by a stop edge 51 of the governor lever 4. In the position shown, the piston 49 is just now assuming the position for normal operation; broken lines indicate the starting position, in which the stop edge 51 is moved correspondingly farther inward. On its end face 52, the stop piston 49 is acted upon by the fluid pressure prevailing in the suction chamber 22, which pressure is introduced via a conduit 53 extending within the stop piston 49 and is exerted counter to a restoring spring 54 engaging the stop piston 49 on the other end. At starting speed, that is, at low suction-chamber pressure, the stop piston 49 is displaced into its initial position, so that then, when a pressure corresponding to the normal speed is attained in the suction chamber 22, the stop piston 49 is displaced into the position shown, counter to the force of the restoring spring 54.

Since an electronic control unit is being used anyway, the shutoff of the engine——that is, the interruption of the fuel supply——can be effected electrically as well. To this end, a magnetic valve 55 (FIG. 2) can be provided in the housing 10, which controls the intake bore 20 and blocks it in order to shut off the engine.

Figure 6:
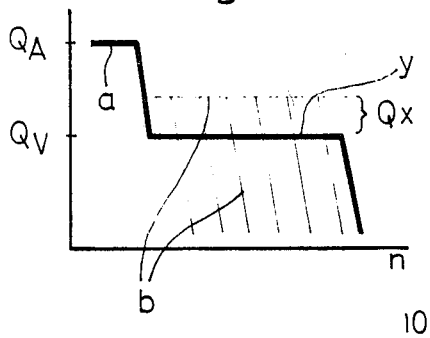
FIG. 6 is a function diagram of the fuel quantity and rpm in the exemplary embodiment.

In the diagram shown in FIG. 6, the injection quantity Q is plotted on the ordinate, and the speed or rpm n is plotted on the abscissa. The characteristic curve a indicates the maximum quantity determined by the travel limiter 9; that is, $Q_A$ for the starting quantity and $Q_V$ for full-load quantity. The symbol b shows the governing range which is traversed by the electric speed governor and is intersected by the full-load characteristic curve of the travel limiter. The quantity difference $Q_X$ corresponds to the travel X in FIG. 2 and is effective only at starting speed, and even then only partially.

Figure 7:
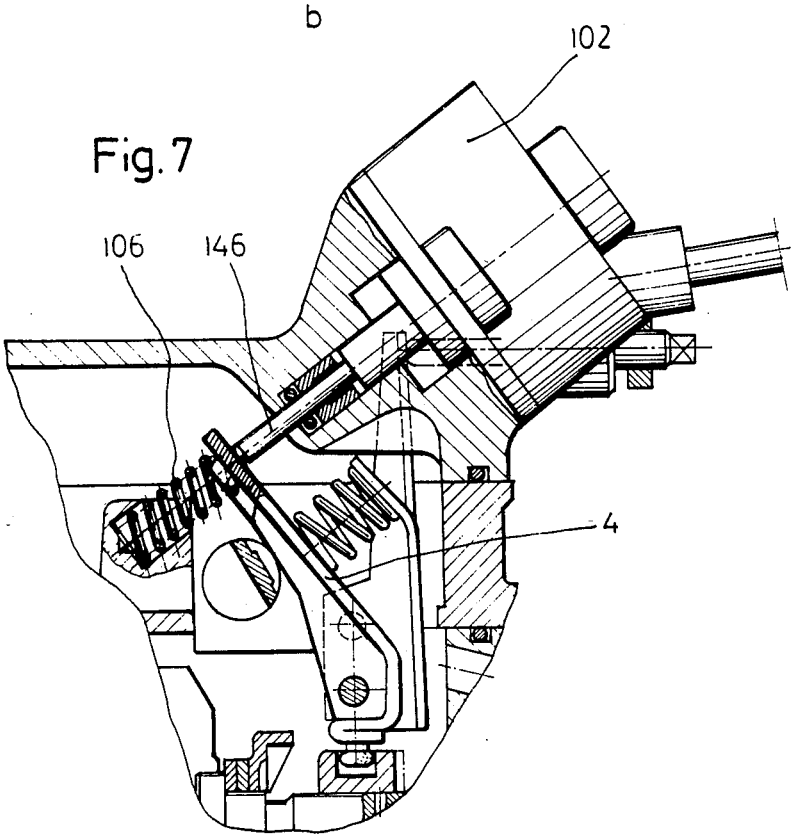
FIG. 7 shows a variant of the governor shown in FIG. 2.

In FIGS. 5 and 7, a variant of this exemplary embodiment is shown in which, unlike what has been described above, the actuation member 146 of the control motor 102 is displaced outward for an increasing injection quantity. The spring 106 therefore acts counter to this adjusting direction. Otherwise the exemplary embodiment is unchanged.

Figure 8:
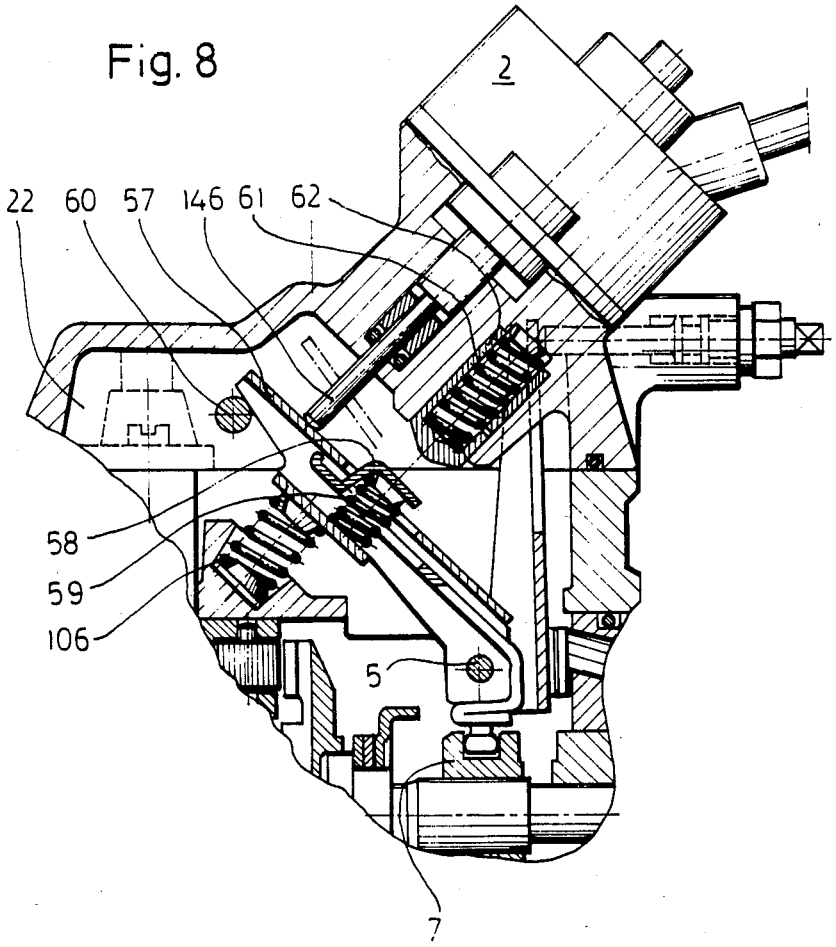
FIG. 8 shows a different variant of the governor shown in FIG. 2.

In FIG. 8, a different variant of the invention is shown, in which the travel limiters for full load and for starting function independently of one another. The governor lever is in two parts here, both levers 57 and 58 being pivotable about the shaft 5; the quantity control member 7 is articulated solely by the lever 58, while in contrast the actuation member 146 and the spring 106 engage the lever 57. At normal speeds, a starting spring 59 provided between the levers 57 and 58 keeps the levers in the illustrated position. In this position, a stop 60 serves as the travel limiting means for the full-load speeds. At starting speeds and with a correspondingly lower pressure in the suction chamber 22, a starting piston 62 is pushed against the lever 58 by a spring 61, so that the lever 58 is raised from the lever 57 counter to the force of the spring 59; as a result, the quantity control member 7 assumes a position for increased starting quantity. Then as soon as the pressure in the suction chamber 22 rises, the starting piston 62 is displaced counter to the spring 61 upon attainment of normal speeds, and the lever 58 is displaced into the position shown by the starting spring 59.

Figure 9:
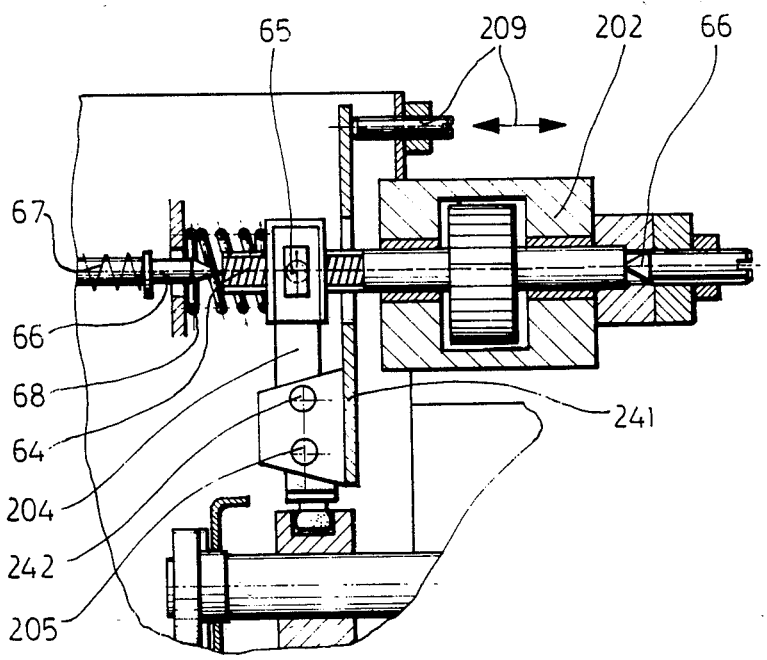
FIG. 9 shows a variant of the electric control motor shown in FIG. 2.

In FIG. 9, in a highly simplified manner, the second exemplary embodiment is shown, in which a stepping motor having a threaded spindle 64 serves as the control motor 202. A nut 65 travels on the spindle 64 and again articulates the governor lever 204. The spindle travels between pointed tips 66 and 66', one of which is biased by a spring 67. In order to obtain play-free adjustment, the nut 65 is biased by a spring 68 in the direction of the control motor 202. The travel limitation 209 for the maximum injection quantity at full-load and during starting is effected via an adjusting lever 241, which supports the pivot shaft 205 of the governor lever 204 and itself is pivotable about a shaft 242.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A speed governor for fuel injection pumps of internal combustion engines, comprising a quantity control member (7), a governor lever (4) operative for controlling said quantity control member, an electric control motor, driven by an electrical signal from an electronic control unit that processes engine parameters without any quantity control member positional feedback relative to said electronic control unit, said electric control motor adapted to actuate said quantity control member of said injection pump, a travel limiting means (9) for said quantity control member which includes a stop position for determining the maximum injection quantity, said travel limiting means for said quantity control member including a piston means (49) that is displacable by hydraulic means counter to a spring force (54) in which a position of said piston means is variable independent of said electric control motor which is operative by said electronic control unit between a position for starting quantity and one for full-load quantity in accordance with engine characteristics.

2. A speed governor as defined by claim 1, further wherein said hydraulic means utilizes fuel as an actuation force and further that control pressure for said hydraulic means is generated by a feed pump of said injection pump, said feed pump being driven in synchronism with speed of said engine.

3. A speed governor as defined by claim 2, further wherein with increasing rpm, said piston means is displaceable out of an initial position for lower pressure, corresponding to starting rpm, into a final position for normal operation.

4. A speed governor as defined by claim 1, further wherein said hydraulic means can be influenced in pressure by a magnetic valve.

5. A speed governor as defined by claim 1, further wherein said travel limiting means cooperates with said governor lever supported on a pivot shaft disposed between said quantity control member and said control motor.

6. A speed governor as defined by claim 5, which includes an adjusting lever (41) which is pivotable about a stationary shaft (55), said pivot shaft being supported by said adjusting lever and is adjustable approximately parallel to the adjusting direction of said quantity control member.

7. A speed governor as defined by claim 5, further wherein said governor lever has a pivoting movement in the direction of an increasing injection quantity, said governor lever further being biased by a spring and limited by said control motor.

8. A speed governor as defined by claim 6, further wherein said governor lever has a pivoting movement in the direction of a decreasing injection quantity, said governor lever further being biased by a spring (6) and limited by said control motor.

9. A speed governor as defined by claim 1, further wherein said piston means is displaceable in the actuation direction of said control motor.

10. A speed governor as defined by claim 1, further wherein said piston means is displaceable transverse to the actuation direction of said control motor.

11. A speed governor as defined by claim 10, further wherein said piston means further includes a stepped stop which is displaceable.

12. A speed governor as defined by claim 11, further wherein said piston means includes a jacket face provided with a contour.

13. A speed governor as defined by claim 5, further wherein said governor lever comprises a starting lever and a pivoting lever, both said levers pivotable about said pivot shaft, said pivoting lever being articulated by said control motor and said starting lever adapted to articulate relative to said quantity control member with both levers being combined into a unit by a starting spring during normal operation, whereby at starting rpm, for the purpose of travel limitation, said starting lever is pivotable away from the said pivoting lever counter to the force of said starting spring, in order to generate an increased starting quantity.

14. A speed governor as defined by claim 13, further wherein at starting rpm, a starting piston is biased by a spring and adapted to engage said starting lever counter to the force of said starting spring and upon attainment of the normal speed the force of said spring is overcome whereby said starting piston can be disengaged from said starting lever.

15. A speed governor as defined by claim 6, further wherein said governor lever comprises a starting lever and a pivoting lever, both said levers pivotable about said pivot shaft, said pivoting lever being articulated by said control motor and said starting lever adapted to articulate relative to said quantity control member with both levers being combined into a unit by a starting spring during normal operation, whereby at starting rpm, for the purpose of travel limitation, said starting lever is pivotable away from the said pivoting lever counter to the force of said starting spring, in order to generate an increased starting quantity.

16. A speed governor as defined by claim 7, further wherein said governor lever comprises a starting lever and a pivoting lever, both said levers pivotable about said pivot shaft, said pivoting lever being articulated by said control motor and said starting lever adapted to articulate relative to said quantity control member with both levers being combined into a unit by a starting spring during normal operation, whereby at starting rpm, for the purpose of travel limitation, said starting lever is pivotable away from the said pivoting lever counter to the force of said starting spring, in order to generate an increased starting quantity.

17. A speed governor as defined by claim 7, further wherein said governor lever comprises a starting lever and a pivoting lever, both said levers pivotable about said pivot shaft, said pivoting lever being articulated by said control motor and said starting lever adapted to articulate relative to said quantity control member with both levers being combined into a unit by a starting spring during normal operation, whereby at starting rpm, for the purpose of travel limitation, said starting lever is pivotable away from the said pivoting lever counter to the force of said starting spring, in order to generate an increased starting quantity.

* * * * *

UNITED STATES PATENT AND TRADEMARK OFFICE

CERTIFICATE OF CORRECTION

PATENT NO. : 4,887,571

DATED : December 19, 1989

INVENTOR(S) : Franz Eheim, deceased, by Helga Eheim

It is certified that error appears in the above-identified patent and that said Letters Patent is hereby corrected as shown below:

Title page, correct "[76] Inventors:" to read:

[75] Inventors: Franz Eheim, deceased, late of Stuttgart, by Helga Eheim, heiress, of Fed. Rep. of Germany and add:

[73] Assignee: Robert Bosch GmbH Stuttgart, Fed. Rep. of Germany

Signed and Sealed this

First Day of January, 1991

*Attest:*

HARRY F. MANBECK, JR.

*Attesting Officer*

*Commissioner of Patents and Trademarks*